US007143712B1

(12) United States Patent
Naslund

(10) Patent No.: US 7,143,712 B1
(45) Date of Patent: Dec. 5, 2006

(54) ANCHOR SYSTEM

(76) Inventor: Harvey Naslund, Box 146, Rollins, MT (US) 59931

( * ) Notice: Subject to any disclaimer, the term of this patent is extended or adjusted under 35 U.S.C. 154(b) by 0 days.

(21) Appl. No.: 11/156,099

(22) Filed: Jun. 17, 2005

(51) Int. Cl.
*B63B 21/24* (2006.01)

(52) U.S. Cl. ..... 114/294; 114/300

(58) Field of Classification Search ..... 114/294, 114/300
See application file for complete search history.

(56) References Cited

U.S. PATENT DOCUMENTS 1,858,347 A 5/1932 Swift
2,204,799 A * 6/1940 Filby ..... 114/300
2,365,136 A * 12/1944 Behrens ..... 114/299
2,464,661 A * 3/1949 Woodland ..... 114/297
4,090,462 A 5/1978 Mount

* cited by examiner

*Primary Examiner*—Sherman Basinger
(74) *Attorney, Agent, or Firm*—Jean Kyle

(57) ABSTRACT

An anchor system has two anchor members pivotally connected and spaced apart head to tail. The anchor member tied to the line is larger than the terminal anchor. The tail of the tethered anchor member rests on the head of the terminal anchor member to stabilize the anchor system when it is deployed and resting on the bottom of a body of water.

2 Claims, 2 Drawing Sheets

ANCHOR SYSTEM

BACKGROUND OF THE INVENTION

The introduction of fish finders and other position locating tools allows a fisherman to identify an exact spot to fish in a body of water. Using a fish finder the fisherman can identify the position and depth of a school of fish. Further a fish finder can be used to review and locate bottom conditions that may provide favorable habitats and hiding places for fish such as drop-offs or ledges. A global positioning satellite (GPS) device can be used to mark the location of a successful fishing hole so a fisherman can return to that spot again and again. Precisely identifying successful fishing spots has become easier using these new technologies. Once the location of a desired fishing hole is identified however a fisherman must be able to position and hold the boat at that spot. Most anchors are dropped from the boat and then dragged along the bottom of a body of water until the anchor catches and holds. Sufficient line tied to the anchor must be released from the boat to allow the anchor to drag along the bottom. Once anchored, the length of the line from the anchor to the boat can be significant. The anchored boat can move the length of that line about the anchor. This movement might be enough to displace the boat from above an identified school of fish. Further, these drag type anchors (see for example U.S. Pat. Nos. 1,858,347 and 4,090,462) rely on catching the bottom of the lake. A simple anchor system that can anchor a boat at a precise location and keep it at that location would provide a distinct advantage to a fisherman.

All patents, patent applications, provisional paten applications and publications referred to or cited herein, are incorporated by reference in their entirety to the extent they are not inconsistent with the explicit teachings of the specification.

BRIEF SUMMARY OF THE INVENTION

The subject invention involves and anchor system that is particularly useful for anchoring a boat at a desired location on a body of water. Two anchor members are pivotally connected and spaced apart so that the anchor member tied to the boat rests upon and holds the terminal anchor member when the anchor system is on the bottom of the body of water. The anchor system effectively anchors a boat when dropped vertically from the boat, and therefore uses little line and allows limited movement of the anchored boat.

DETAILED DESCRIPTION OF THE INVENTION

The invention is an anchor system that effectively holds an anchored boat in position above a desired spot. The system comprises two anchor members pivotally connected but spaced apart so the first anchor member rests upon and stabilizes the terminal anchor member when the anchor system is deployed and on the bottom of a body of water.

Figures 1, 2:
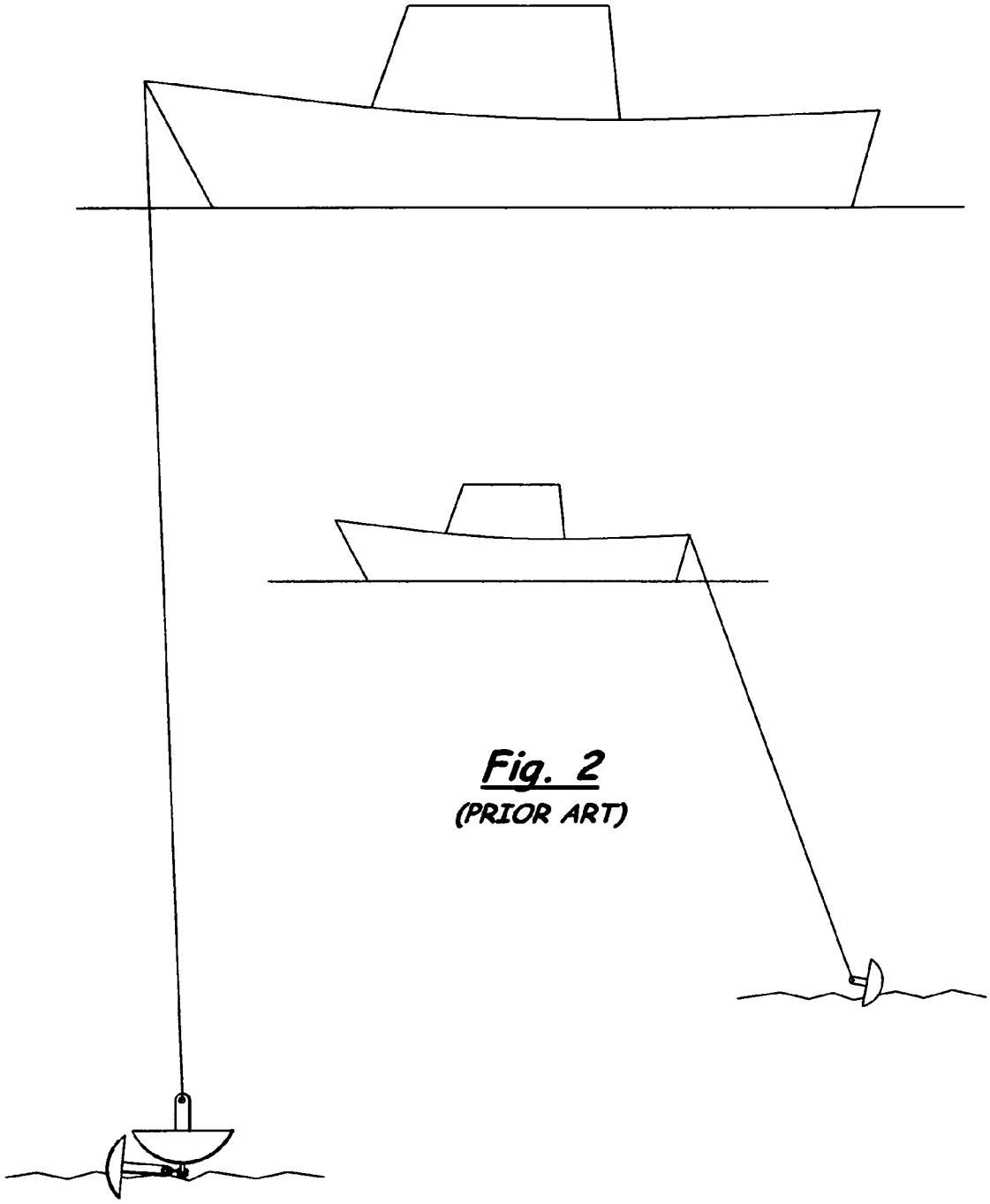
Fig. 2 (PRIOR ART)
FIG. 1 is an environmental view of a preferred embodiment of the anchor system of the subject invention.
FIG. 2 is an environmental view of a prior art anchor system.

The subject anchor system is deployed off the bow of the boat to anchor the boat in a precise spot (FIG. 1). The subject anchor system uses about one third the line of a conventional anchor since it is dropped at the desired location. Traditional drag anchors (FIG. 2) must catch and hold the bottom of the body of water so they are deployed prior to reaching the desired location. The excess line of a drag-type anchor allows the anchored boat to move the length of the line about the anchor. Therefore, drag-type anchors do not hold the anchored boat to a precise spot. The boat is easily displaced by wind, waves or current. The anchor system of the subject invention however is a vertical line anchor which is dropped at the desired location from the bow of the boat. The anchored boat is only allowed to pivot about the anchored spot insuring the boat will not leave the identified fishing spot. Further, if displaced, the subject anchor system resets itself immediately.

Figure 3:
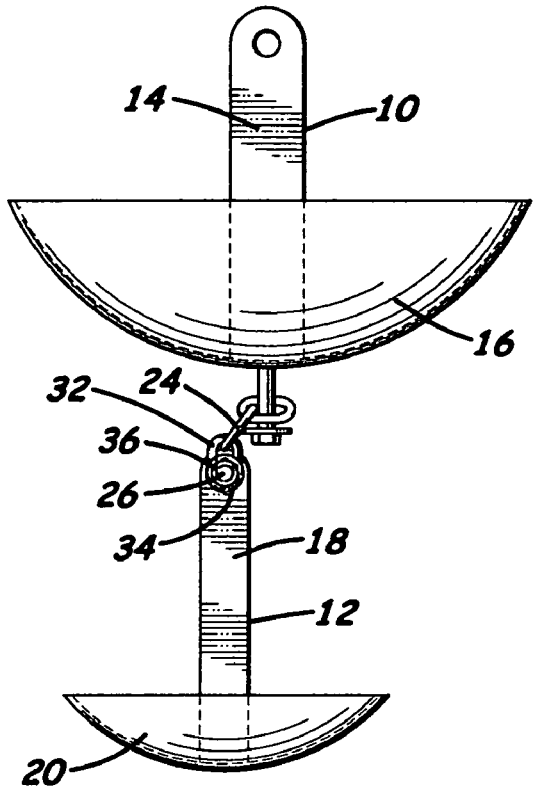
FIG. 3 is a side elevational view of a preferred embodiment of the anchor system of the subject invention.

The anchor system of the subject invention comprises two anchor members pivotally connected and spaced apart in a head to tail configuration. A preferred embodiment of the subject anchor system is shown in FIG. 3. The anchor system has a first anchor member 10 and a second anchor member 12. The first anchor member 10 has a first end 14 and second end 16. The first end 14 is typically tied to a line attached to the boat to be anchored. The second end 16 is pivotally connected and spaced apart from the second anchor member 12. The first end 18 of the second anchor member is attached to the second end 16 of the first anchor member. The second end 20 of the second anchor member or terminal anchor member therefore reaches the bottom of the body of water first when the anchor system is deployed from a boat.

In an exemplified embodiment, the anchor members are mushroom-type anchors. These anchors have a stem and body. The body is more weighted relative to the stem and thus descends more quickly. In the exemplified embodiment, the stem is the first end of each anchor member and the body is the second end of each anchor member. Although mushroom anchors are shown for use in the subject anchor system it is noted that many anchor types could be used it is important only that the anchor members have two ends.

Figure 4:
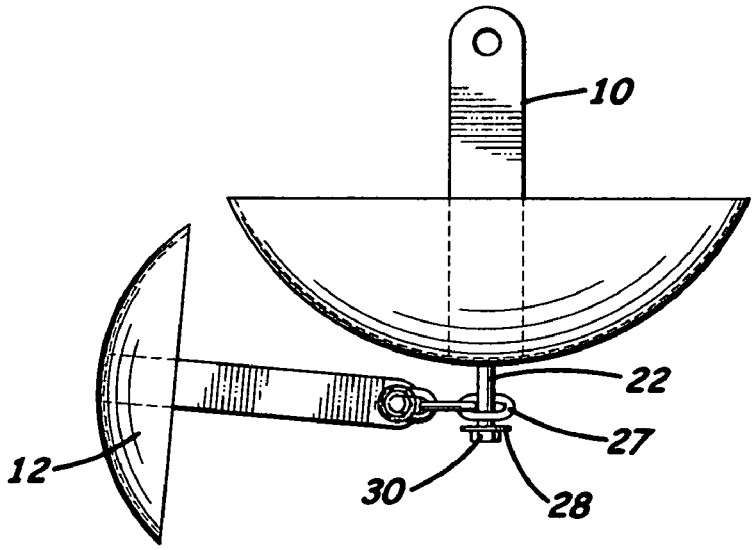
FIG. 4 is a side elevational view of a preferred embodiment of the anchor system of the subject invention in use.

The first and second anchor members are pivotally connected and spaced apart when the second end, or tail, of the first anchor member is connected to the first end, or head, of the second anchor member. The second anchor member pivots beneath the first anchor member so the first anchor member can rest upon and stabilize the second anchor member when the anchor system is on a surface for example, at the bottom of a lake (FIG. 4). The pivot must be sufficient to allow the second anchor member to swing about 90 degrees relative to the first. The spacing further must be sufficient, yet not too great, to allow the tail of the first anchor member to rest upon the head of the second anchor member. It is apparent to those skilled in the art that there would be a number of ways to provide this pivotally and spaced connection. The exemplified embodiment shows a simple yet effective connector. A pin 22 protrudes from the second end 16 of the first anchor member 10. A pivoting linkage 24 moves slidably along the pin and to an axle 26 attached to the first end 18 of the second anchor member 12. In the exemplified embodiment, the pin 22 is a threaded bolt and the pivoting linkage 24 is three links of a chain. One chain link 27 is threaded onto the pin and secured to the pin with an enlarged washer 28 and a nut 30. The chain link moves freely up and down the length of the pin. Another link of the chain 32 is secured to the axle 26 which is placed through an aperture in the stem of the second anchor member. In the exemplified embodiment, this axle too is a threaded bolt. A washer can be used to prevent the bolt head from sliding through the aperture. An enlarged washer 34 and nut 36 secure the chain link 32 to the axle 26. The enlarged washers assist in off-setting the anchor members allowing the anchor system to hit the bottom more smoothly. The exemplified embodiment is constructed of available, easy to configure components. It is contemplated that specialized linkages could be developed that serve the same purpose.

The connection between the first and second anchor members must allow the second anchor member to pivot beneath the first and be spaced apart so the second end of the first anchor member can rest upon the first end of the second anchor member. The first anchor member thus stabilizes the second. In a particularly preferred embodiment, as shown in the exemplified embodiment, as the anchor system heads to the bottom of the lake, the pin 22 is driven into the lake bottom providing additional stability. Also preferred is that the first and second anchor members are of disparate weights. Preferably, the fist anchor member should outweigh the second anchor member and most preferably, the weight difference should be about two times. For example, an effective anchor system for a nineteen foot fiberglass boat uses a 30 pound mushroom anchor for the first anchor member and a 15 pound mushroom anchor for the second anchor member. Differences in weight correlate with differences in size of anchor members and thus it is only necessary that the first anchor member be large enough to rest upon and hold the second anchor member.

It is understood that the foregoing examples are merely illustrative of the present invention. Certain modifications of the articles and/or methods employed may be made and still achieve the objectives of the invention. Such modifications are contemplated as within the scope of the claimed invention.

The invention claimed is:

1. An anchor system comprising:

a first anchor member having a first end and a second end;

a second anchor member having a first end and a second end;

wherein the second end of the first anchor member is pivotally connected and spaced apart from the fist end of the second anchor member by an axle connected to the first end of the second anchor member which is attached to a chain which is slidably connected to a pin protruding from the second end of the first anchor member, wherein when the first end of the first anchor member is tied to a line and deployed, a washer at the distal end of the pin off-sets the second anchor member allowing the second end of the first anchor member to rest upon and hold the first end of the second anchor member when the anchor system is on a surface.

2. An anchor system comprising:

a first mushroom-type anchor member having a first end and a second end;

a second mushroom-type anchor member having a first end and a second end, the second anchor member weighing about one-half the weight of the first anchor member;

wherein the second end of the first anchor member is pivotally connected and spaced apart from the first end of the second anchor member by an axle connected to the first end of the second anchor member which is attached to a chain which is slidably connected to a pin protruding from the second end of the first anchor member, wherein when the first end of the first anchor member is tied to a line and deployed, a washer at the distal end of the pin off-sets the second anchor member allowing the second end of the first anchor member to rest upon and hold the first end of the second anchor member when the anchor system is on a surface.

* * * * *